United States Patent [19]

Brindisi

[11] 3,934,281

[45] Jan. 27, 1976

[54] MATTRESS COMPRESSION LINKAGE FOR CONVERTIBLE SOFA-BED

[75] Inventor: Joseph A. Brindisi, Uniondale, N.Y.

[73] Assignee: Castro Convertible Corporation, New Hyde Park, N.Y.

[22] Filed: Oct. 30, 1974

[21] Appl. No.: 519,282

[52] U.S. Cl. ..... 5/13; 5/51 H

[51] Int. Cl.[2] ..... A47C 17/14

[58] Field of Search ..... 5/12, 13, 22, 51 H

[56] References Cited

UNITED STATES PATENTS

| | | | |
|---|---|---|---|
| 2,844,827 | 7/1958 | Bank et al. | 5/13 |
| 2,975,433 | 3/1961 | Coopersmith et al. | 5/13 |
| 3,345,651 | 10/1967 | Fox | 5/13 |
| 3,380,083 | 4/1968 | Mikos | 05/13 |
| 3,740,775 | 6/1973 | Metayer | 05/13 |

*Primary Examiner*—Casmir A. Nunberg

*Attorney, Agent, or Firm*—Curtis, Morris & Safford

[57] ABSTRACT

In a convertible sofa-bed in which a mattress is folded over upon itself, a bed-folding linkage is provided which compresses the mattress with great leverage, thus providing means for facilitating the opening and closing of the sofa-bed, even when using relatively thick mattresses. The bed mechanism includes a mattress support having first, second, third and fourth hinged sections whose folding is controlled by the bed-folding linkage. The mattress-compression linkage includes a first link connected to the first or foot section, and a second link connected to the third section of the mattress support structure. An abutment is provided on the third section. The abutment is located so that when the bed is folded up, the second link hits the abutment and this causes the linkage to be pulled tight and locked in place to compress the folded mattress in a compressed condition. The pivot point of the mattress-compression linkage on the first section of the mattress support is a substantial distance from the junction between the first and second sections of the mattress support, thus giving substantial leverage to the mattress-compression linkage. A further linkage is provided for moving the pivot point on the first section even farther away from the junction so as to increase the leverage even further. A locking linkage is provided to lock the corner between the second and third sections of the mattress support and hold it in a rigid position when the bed is folded.

8 Claims, 8 Drawing Figures

MATTRESS COMPRESSION LINKAGE FOR CONVERTIBLE SOFA-BED

This invention relates to convertible sofa-beds, and particularly to convertible sofa-beds in which the mattress is folded over upon itself and compressed for storage inside the sofa when the sofa-bed is to be used as a sofa.

One of the most persistent problems in sofa-beds of the above type is in providing means for easily compressing the folded mattress of the bed so that it will fit into the sofa. It is desired to provide a compression mechanism which requires so little operating force that even a young child can fold the sofa-bed. This problem has been aggravated by the increased demand for thicker and more comfortable mattresses. Although successful mattress compression linkages have been provided in prior sofa-beds, the manufacturing cost has been relatively high.

Accordingly, it is an object of the present invention to provide a convertible sofa-bed with a mattress compression mechanism which is relatively easy to operate and inexpensive to manufacture. It also is desired to provide such a mechanism which, when folded, provides a relatively soft seat platform for the seat cushions of the sofa.

The foregoing objects are met, in accordance with the present invention, by the provision of a convertible sofa-bed having a folding mechanism for supporting a mattress when unfolded and for supporting a seat when folded. The mechanism has first, second and third sections pivotably connected in series with one another, and a mattress compression linkage. The compression linkage includes a first link pivotably connected adjacent one of its ends to the first section at a position separated by a substantial distance from the pivot point between the first and second sections, and a second link pivotably connected adjacent one of its ends to the first link adjacent the other end of the first link. The second link is pivotably connected adjacent its other end to the third section. There also is abutment means on the third section for engaging the second link when the mechanism is folded and thereby pulling the first link towards the third section to compress the folded-over mattress between the first and third sections. The mechanism preferably includes a third link pivotably connected between the second and third sections, and locking means for moving and holding the pivot point of the third link away from the pivot point between the second and third sections when the mechanism is folded. The mechanism also preferably includes a shifting link pivotably connected to the first section, the one end of said first link being pivotably connected to the shifting link, and means for moving the shifting link during folding of the mechanism to move the pivot point of the first link farther from the pivot point between the first and second sections to increase the mattress compression leverage of the linkage.

The foregoing and other objects and advantages of the invention will be described in or apparent from the following description and drawings.

Figure 2:
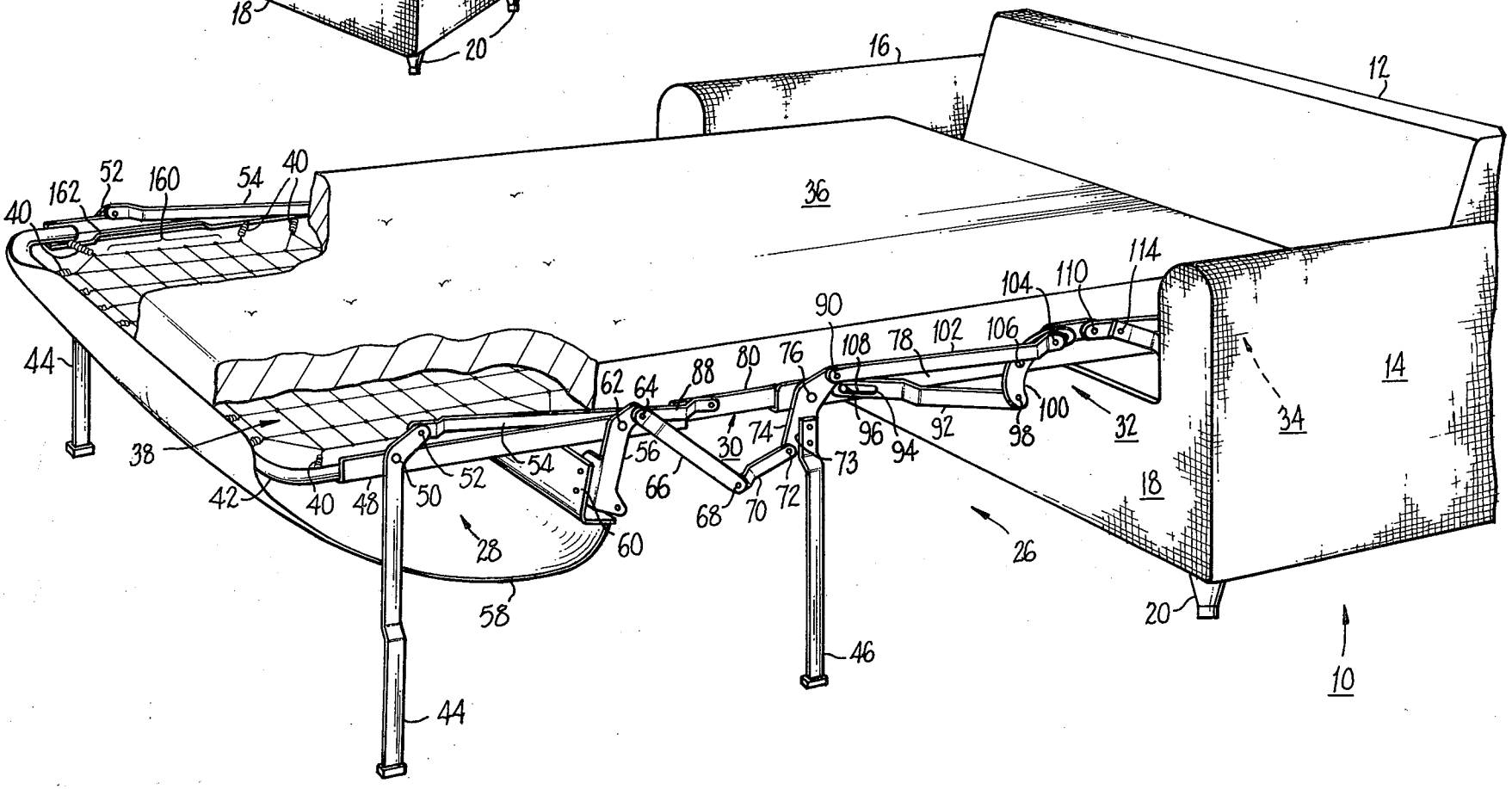
FIG. 2 is a perspective, partially-broken away view of the sofa-bed of FIG. 1 unfolded for use as a bed.
Figure 1:
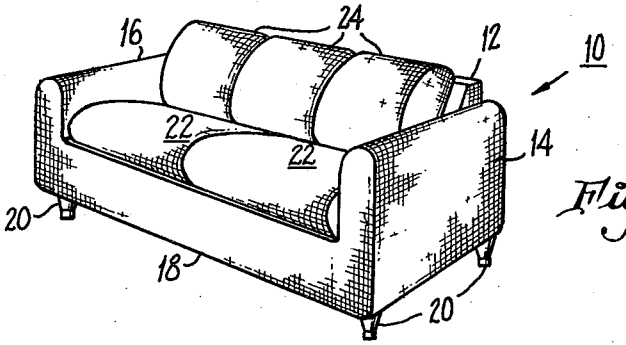
FIG. 1 is a perspective view of a convertible sofa-bed constructed in accordance with the present invention, folded up for use as a sofa.
Figure 3:
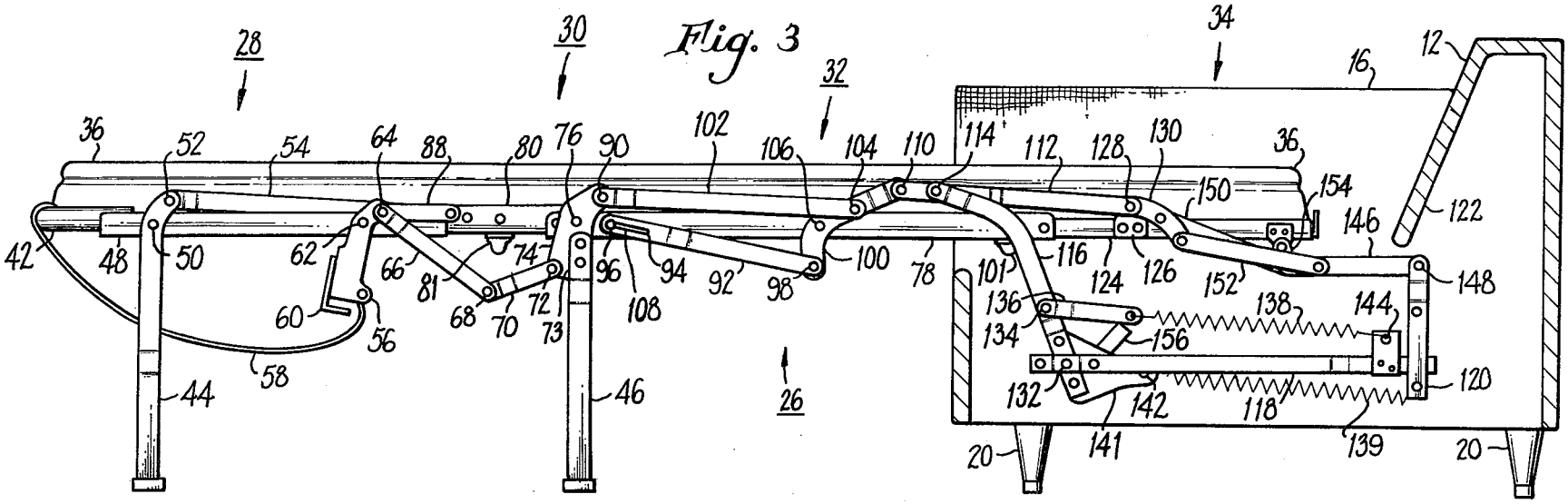
FIG. 3 is a cross-sectional view of the sofa-bed of FIG. 2, taken along line 3—3 of FIG. 4.
Figure 4:
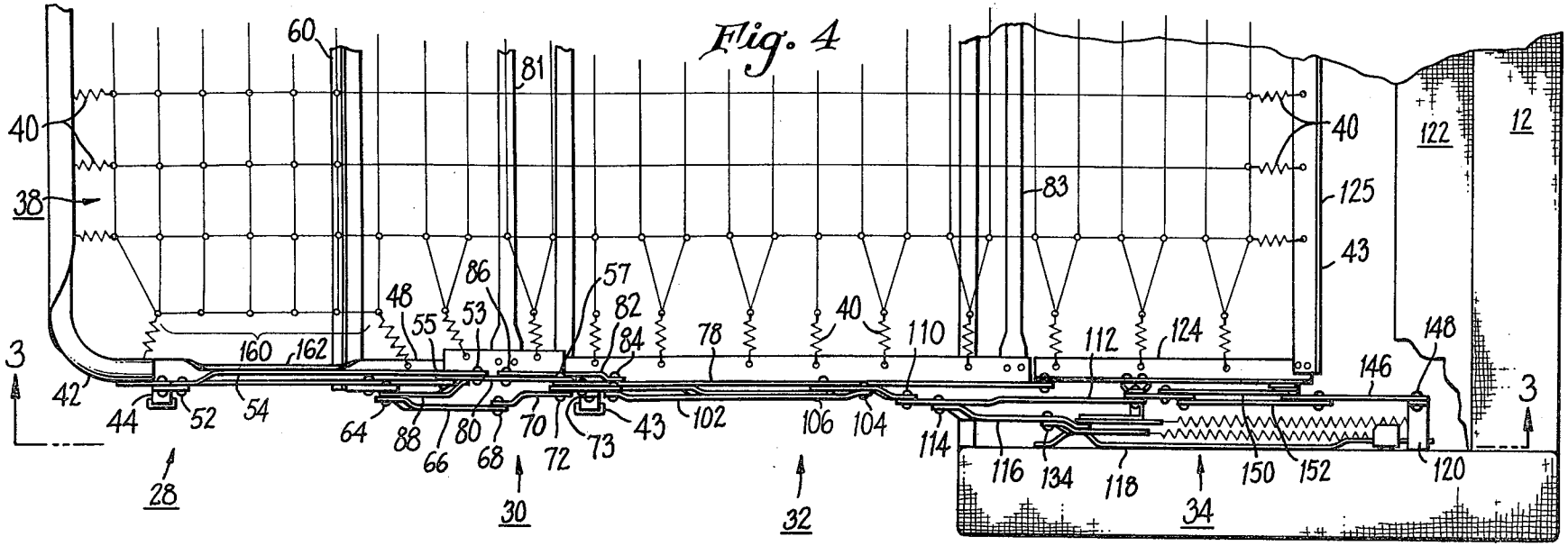
FIG. 4 is a plan view of a portion of the sofa-bed shown in FIG. 2.
Figure 6:
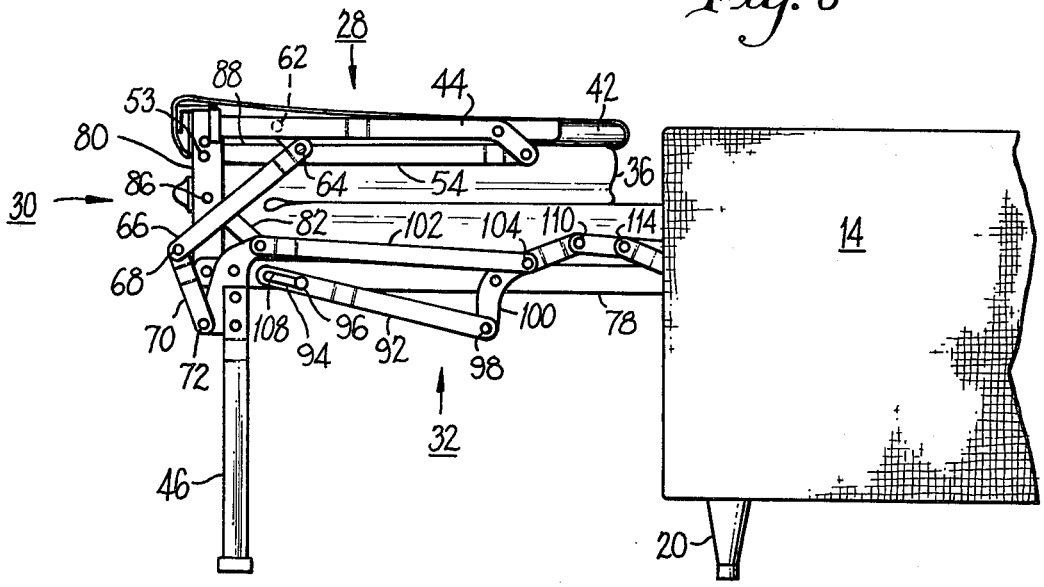
Figure 7:
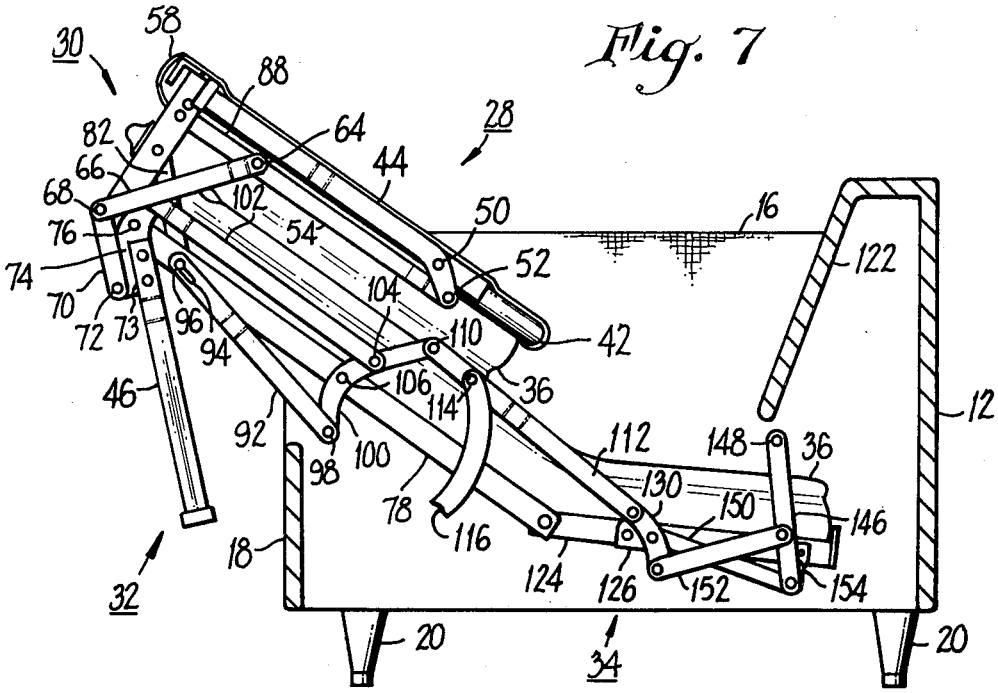
Figure 8:
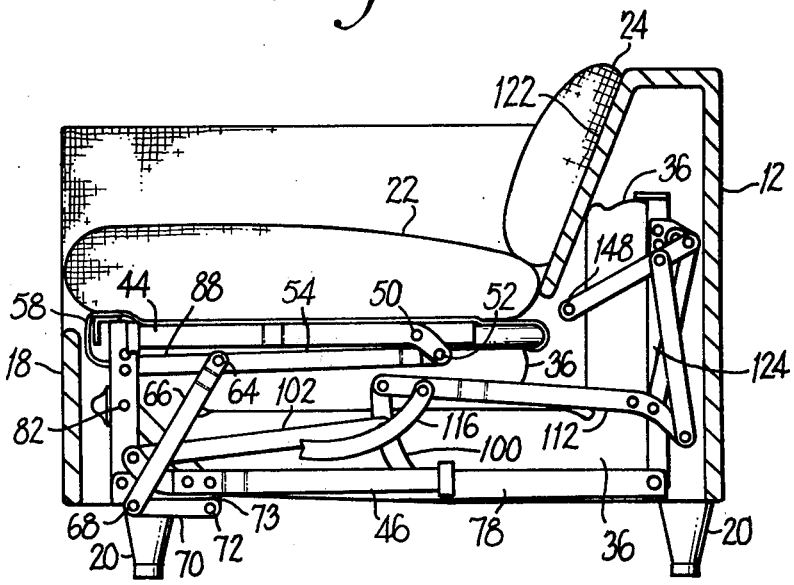

FIGS. 5, 6, 7 and 8 are elevation views (FIGS. 7 and 8 being partially cross-sectional) of the mechanism shown in FIGS. 2 through 4, in various different positions during folding of the bed into the sofa frame to convert the bed shown in FIGS. 2 through 4 into a sofa as shown in FIGS. 1 and 8.

Referring first to FIG. 1, the sofa-bed 10, ready for use as a sofa, includes a back 12, sides 14 and 16, a front portion 18, and legs 20. Three loose back-cushions 24 and two loose seat-cushions 22 are provided.

When converting the sofa into a bed, the seat-cushion 22 and the back cushions 24 are removed, and the bed mechanism is lifted out of and unfolded from the sofa frame to form a bed as shown in FIGS. 2, 3 and 4. The bed includes a mattress 36 on a mattress support structure 26. Two people can sleep on the mattress 36, preferably with their heads nearest the sofa, and their feet farthest away from the sofa.

Referring next to FIGS. 2 through 8, but particularly to FIG. 3, the mattress support structure 26 has four sections 28, 30, 32 and 34. The four sections are pivotably connected in series with one another, as it will be explained in greater detail below. The first section 28 is located at the foot of the bed, and sometimes is referred to as the "foot section". The second section 30 is relatively shorter than any of the other sections, and is referred to sometimes as the "connecting section". Similarly, the third section 32 sometimes will be referred to as the "middle section", and the fourth section 34 as the "head section".

Two folding mechanisms are provided, one on each side of the bed, with one mechanism being the mirror-image of the other. Because of this mirror-image relationship, only one of the mechanisms will be described, since the operation of the other will be readily apparent.

Now referring to FIGS. 2 and 4, the mattress 36 shown in FIG. 2 is supported on a wire mesh structure 38 supported by tensioned helical springs 40 fastened to the frame members forming the first, second, third and fourth sections of the mattress support 26. Referring particularly to FIGS. 3 and 4, the frame includes angle iron frame members 48 (one on each side) joined by another frame member 42 at the foot of the bed. Also, the frame includes angle iron side members 80, 78, and 124 at the side of the bed, and an angle iron member 125 joining the side members at the head of the bed. The mattress 36 rests on the springy mattress support thus formed.

Each bed folding mechanism includes two folding legs 44 and 46, the leg 44 being located near the foot of the bed, and the leg 46 being located near the middle of the bed. The bed, as it is shown in FIGS. 2, 3 and 4, is supported in the horizontal position by the legs 44 and 46, and by other support mechanism fastened to the sofa frame, as it will be explained in greater detail below.

The leg 44 and the mechanism used to fold it are conventional. The leg 44 has a curved upper portion 52, and is pivoted to the side rail 48 at point 50. A pusher bar 54 is pivotably connected to the angle 80 of the second section 30 of the mechanism at point 53 (see FIGS. 4 and 5). As the foot of the bed mechanism is lifted up to the positon shown in FIG. 5 in order to fold the mechanism, the pusher 54 pushes the top of the leg 44 about the point 50 and rotates the leg to a position substantially parallel with the angle iron 48 at the side of the foot section 28 (see FIG. 6). When the mattress is folded over upon itself, as shown in FIG. 6, its resiliency causes it to tend to spread apart. This is undesirable because the mattress must be folded over upon itself tightly in order to be compact enough to be stored within the sofa frame.

In accordance with the present invention, a mattress compression linkage is provided. This linkage consists of a first link 66 and a second link 70 which are pivotably connected together at a point 68. The first link 66, which is the longer of the two links, is pivotably connected at a point 64 to the upper end of a crank member 56 (see FIG. 3) which is pivotably connected to the side rail 48 of the foot section at point 62. The shorter link 70 is pivotably connected at point 72 to a leg-folding plate 74 to which the leg 46 is secured. The plate 74 is pivotably connected to the left end of the side-rail 78 of the middle section 32.

As is best evident in FIGS. 3 and 4, the upper end of the leg 46 is secured to the plate 74 by means of rivets, and both the member 70 and the upper end of the leg 46 are positioned on the same surface of the plate 74. Thus, as it will be seen from the detailed discussion below, the surface 73 of the upper portion of the leg 46 serves as an abutment or stop against which the link 70 hits, during folding of the bed mechanism, to pull the link 66 towards the bed section 32 and thus compress the mattress.

Still referring to FIGS. 3 and 4, the leg-folding plate 74 has an upper end to which a pusher rod 102 is pivoted at point 90. Member 102 is pivotably connected at 104 to a crank member 100 which is pivoted at 106 to the side rail 78. Pivoted at 110 to the upper end of the crank 100 is a link 112 which is pivoted at 128 to a upstanding tab 126 which is connected to the side rail 124 of the fourth or "head" section 34 of the sofa-bed.

Pivoted at 114 to the member 112 is a curved guiding member 116 which is pivotably mounted at point 132 to a horizontal mounting bar 118 which is secured to the sofa frame. Links 130, 150, 152, 154 and 146 are connected as shown between points 128 and 148. Point 148 is on a vertical support member 120 which is secured to the sofa frame. This linkage guides the sofa-bed mechanism out of the sofa frame substantially as described in U.S. Pat. No. 3,654,642, which is assigned to the same assignee as this patent application.

A tension spring 138 is connected by means of a link 136 pivoted to the member 116 at point 134. The other end of spring 138 is secured at a point 144 to the horizontal support member 118. Another tension spring 130 is connected at one end at point 142 on a plate 141 attached to the lower end of member 116. The other end of spring 139 is secured to the vertical support member 120. The springs 138 and 139 provide forces which assist the operator in pulling the bed out of the sofa frame and unfolding it.

The folding of the leg 46 and the compression of the mattress 36 are illustrated best in FIGS. 6, 7 and 8. As the bed is lifted upwardly and pushed toward the sofa frame, to the position shown in FIG. 7, the link 112 pushes the top of the crank 100 about its pivot point 106, which pushes the rod 102, which pushes the top of the plate 74 about its pivot point 76. This swings the leg 46 up to a position parallel with the slide-rail 78 and allows the leg to clear the frontboard 18 of the sofa frame and move into the frame. As this rotation takes place, the point 72 at which link 70 is pivoted to the plate 74 also rotates about the point 76 and brings the link 70 directly under the edge 73 of the upper portion of the leg 46. As the point 72 rotates further, the link 70 comes into abutment with the edge 73, and this causes the link 66 to be pulled toward the middle section 32 of the mechanism. This provides the compressive force to compress the mattress between the first and third sections of the mattress support. Since the pivot point 64 is located at a substantial distance from the pivot point of the connection between the connecting section 30 and the first section 28, a substantial amount of leverage is available to compress the mattress.

As it is best seen in FIGS. 6, 7 and 8, a corner link 82 is provided in order to lock the corner formed by the junction between the connecting section 30 and the third or middle section 32 of the sofa-bed. The corner link 82 is pivoted at 86 to the side-rail 80 of the connecting section, and is fastened to a pin 96 with an enlarged head which slides in a slot 108 in the side rail 78, and also in a slot 94 in a member 92 which is pivoted at a point 98 to the bottom of the crank 100.

Referring to FIG. 3, when the mechanism is in its open position forming a bed, the pin 96 is pulled to the left end of the slots 94 and 108, and this tends to lock the bed to prevent its folding up when a person sits or lies down on it.

Figure 5:
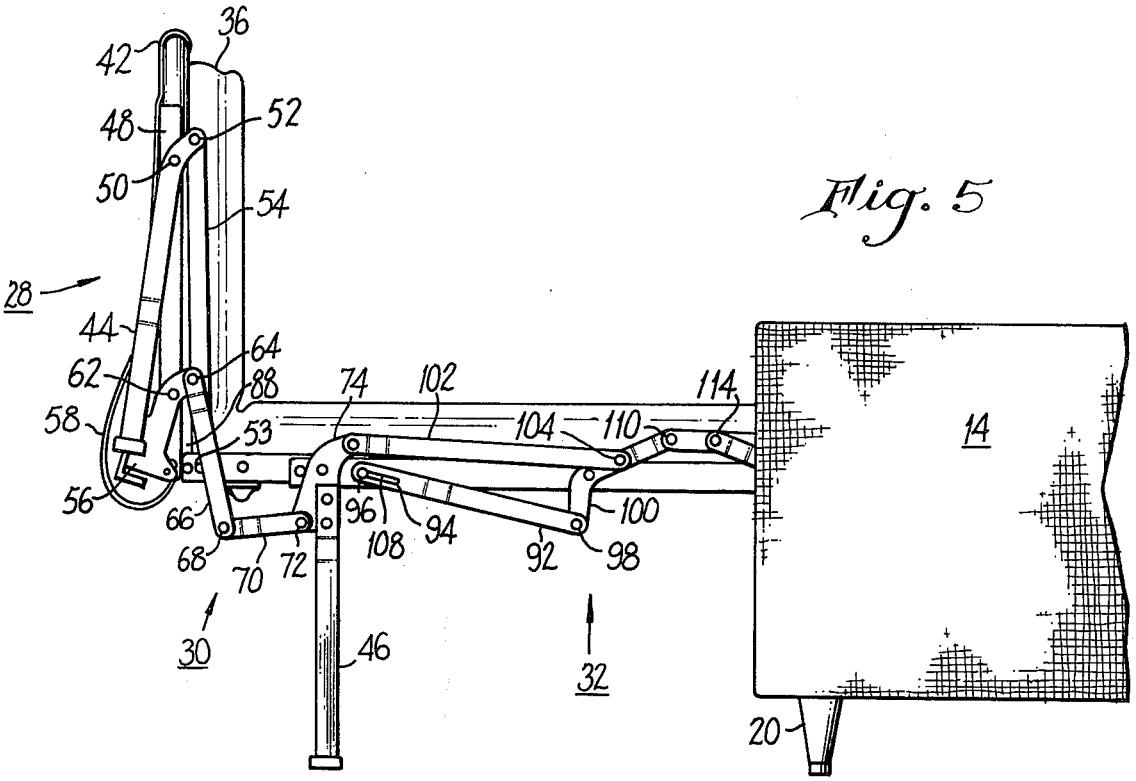

With the mechanism in the position shown in FIG. 5, the corner link 82 remains in its initial position. However, when the bed is folded further to the position shown in FIG. 6, the pin 96 slides to the right end of the slots 94 and 108. As the bed is folded still further and takes the successive positions shown in FIGS. 7 and 8, the point 98 on crank 100 rotates counter-clockwise about pivot 106, causing the link 92 to pull the pin 96 and hold the corner link 82 in a position in which the connecting section side-rails 80 are perpendicular to the rails 78 of the mid-section of the sofa-bed. This helps to provide a solidly-locked folded sofa-bed mechanism which will consistently fit neatly into the sofa frame.

In accordance with another feature of the invention, as it is best shown in FIG. 3, the link 66 is fastened at a point 64 to the crank member 56. Also connected at point 64 is a link 88 which is pivoted to the left end of the side-rail 80. As the bed is folded (see FIG. 5) the plate 56 pivots counter-clockwise about the point 62, thus moving the point 64 farther away from the pivoted connection between the foot section 28 and the connecting section 30 of the sofa-bed mechanism. This further increases the leverage applied by the mattress compression linkage to the mattress.

The plates 56 on both sides of the sofa-bed mechanism carry a transverse plate 60 which extends across the bed to help tie the two side mechanism together. The plate 60 is attached to the plates 56 so as to be rotated downwardly away from the surface of the bed when it is to be slept on, but is near to the mattress supporting surface at the rear of the foot section when the bed is folded up.

Further transverse support members are provided at 81 and 83 (see FIGS. 3 and 4). A further transverse member 156 is fastened to the plate 141 so as to swing downwardly when the sofa-bed is in its folded position and there forms an underlying support for the folded-up mechanism to keep it from sinking downwardly when it is sat upon when the sofa-bed is used as a sofa.

The seat of the sofa-bed is designed to be extremely soft. Two features are provided to enchnce this softness.

Referring to FIGS. 2 and 4, the horizontal flanges of the side rails 48 are bent upwardly at locations 162 approximately in the center of the foot section 28 of the sofa-bed mechanism. This prevents the horizontal flanges from extending into the seating area of the sofa too far, and presents a rounded upper surface which is not uncomfortable to a person sitting on the sofa.

The second softening feature is provided by omitting the helical springs 40 from sections 160 of the wire mesh mattress support (see FIGS. 2 and 4) which are approximately parallel to the sections 162 of the side-rails 48.

A seat cover 58 is attached to the plates 56 and at the end member 42. When the sofa-bed is folded up as shown in FIG. 8, the seat protector 58 forms a protector for the cushions and prevents them from abrading against the wire mesh of the mattress support.

The sofa-bed 10 described above meets the objectives set forth at the beginning of this specification. The mattress compression linkage described provides an increased amount of mattress compression leverage compared with prior devices, and thus is relatively easy to operate. Furthermore, the mechanism is relatively simple and inexpensive to manufacture. The seat formed by the mechanism is exceptionally soft and pliable, and thus is very comfortable to sit on. The folded mechanism is stable and true in its path of travel so as to minimize wear by parts rubbing against the sofa frame and upholstery.

The above description of the invention is intended to be illustrative and not limiting. Various changes or modifications in the embodiments described may occur to those skilled in the art and these can be made without departing from the spirit or scope of the invention.

I claim:

1. In or for a convertible sofa-bed, a folding mechanism for supporting a mattress when unfolded and for supporting a seat when folded, said mechanism having first, second and third sections pivotably connected in series with one another, a mattress compression linkage comprising a first link pivotably connected adjacent one of its ends to said first section at a position separated by a substantial distance from the pivot point between said first and second sections, a second link pivotably connected adjacent one of its ends to said first link adjacent the other end of first link, said second link being pivotably connected adjacent its other end to said third section, abutment means on said third section for engaging said second link when said mechanism is folded and thereby pulling said first link towards said third section to compress the folded over mattress between said first and third sections, a shifting link pivotably connected to said first section, said one end of said first link being pivotably connected to said shifting link, and means for moving said shifting link during folding of the mechanism to move the pivot point of said first link farther from said pivot point between said first and second sections to increase the mattress compression leverage of said linkage.

2. Apparatus as in claim 1 including a third link pivotably connected between said second and third sections, and locking means for moving and holding the pivot point of said third link away from the pivot point between said second and third sections when said mechanism is folded.

3. Apparatus as in claim 1 including a folding bed support leg pivotably connected to said third section, said other end of said second section being pivotably connected to said leg, said leg comprising said abutment.

4. Apparatus as in claim 2 in which said locking means includes a slot in a member forming said third section, a pin slidably mounted in said slot and attached to one end of said third link, a fourth link with another slot adjacent one end, said pin being slidably mounted in said other slot, and crank means for pulling said fourth link to slide said pin in said first-named slot away from said pivot point between said second and third sections.

5. Apparatus as in claim 1 including a fourth section pivotably connected to said third section, and further folding means for folding said fourth section up into the hollow back of said sofa when said bed is folded.

6. In or for a convertible sofa-bed, a folding mechanism for supporting a mattress when unfolded and for supporting a seat when folded, said mechanism having first, second and third sections pivotably connected in series with one another, a mattress compression linkage comprising a first link pivotably connected adjacent one of its ends to said first section at a position separated by a substantial distance from the pivot point between said first and second sections, a second link pivotably connected adjacent one of its ends to said first link adjacent the other end of first link, said second link being pivotably connected adjacent its other end to said third section, abutment means on said third section for engaging said second link when said mechanism is folded and thereby pulling said first link towards said third section to compress the folded over mattress between said first and third sections, said first section having a spring-mounted mattress support web which serves as a seat-support web when the bed is folded, said first section also having angle-iron side rails with one flange on the angle iron bent over towards the other flange to form a rounded edge facing upwardly when the bed is folded and thus minimize the metal surface area under the sofa seat.

7. Apparatus as in claim 6 in which said mattress-support web has springs attached to said side rails only adjacent each end of said first section, so as to soften the support provided for seat cushions on said sofa.

8. Apparatus as in claim 1 in which said shifting link includes a seat support bar connected to another shifting link on the opposite side of said mechanism, said moving means being adapted to swing said support bar downwardly away from said first section when said bed is unfolded, and to a position closely adjacent said first section when said bed is folded.

* * * * *